United States Patent [19]

Nielsen et al.

[11] 4,102,101

[45] Jul. 25, 1978

[54] GLASS PANES, AND BUILDINGS AND THE LIKE INCLUDING GLASS PANES

[75] Inventors: Carl Philip Nielsen, Hunters Hill; Noel Sydney Davidson Wood, East Lindfield, both of Australia

[73] Assignee: Harnee Pty. Ltd., Waverton, Australia

[21] Appl. No.: 748,870

[22] Filed: Dec. 9, 1976

[51] Int. Cl.[2] ..... A63B 61/00; E04B 2/56

[52] U.S. Cl. ..... 52/263; 52/105; 52/264; 52/308

[58] Field of Search ..... 428/35, 187; 272/3; 273/95 H; 52/105, 263, 264, 308

[56] References Cited

U.S. PATENT DOCUMENTS

| | | | |
|---|---|---|---|
| 2,107,141 | 2/1938 | Colt | 272/3 |
| 3,779,547 | 12/1973 | Pappas | 272/3 |
| 3,874,977 | 4/1975 | Pyles | 428/35 |
| 3,996,711 | 12/1976 | Pearson | 52/308 X |

FOREIGN PATENT DOCUMENTS

| | | | |
|---|---|---|---|
| 987,416 | 4/1951 | France | 52/263 |
| 1,205,110 | 9/1970 | United Kingdom | 52/308 |

*Primary Examiner*—Alfred C. Perham

*Attorney, Agent, or Firm*—Ladas, Parry, Von Gehr, Goldsmith & Deschamps

[57] ABSTRACT

A glass pane has a broken pattern of dots of an opaque non-reflective material applied to one side thereof. The pattern is applied as a ceramic ink fused into the glass surface in the heat toughening step. The arrangement of dots is such that the pattern occupies 10% to 30% of the pane surface and comprises 30 to 50 dots per linear inch. A squash or like court formed from a number of such glass panes is such that players within the court are not distracted by spectators outside and can follow the path of a squash ball with ease, whereas spectators outside the court, by virtue of differential lighting as between court and spectator area, can watch the activity within the court without diminished vision.

4 Claims, 3 Drawing Figures

GLASS PANES, AND BUILDINGS AND THE LIKE INCLUDING GLASS PANES

This invention relates to glass panes and to buildings and the like including glass panes.

There are occasions when it is desired that persons on one side of a glass pane can view what is happening on the other side without undue loss of clarity while persons on the said other side are not unduly distracted by reflections from the pane and by persons moving on the said other side. An example is where the whole or part of one or more walls of a squash court consists of a glass pane, with spectators on one side and players on the other. Differential lighting, with the playing area well lit, and the seating area not so well lit, assists in attaining this objective, but an ordinary transparent glass pane cannot be used successfully except for the back wall. The present invention provides glass panes which will enable the said objective to be achieved when used for the side and/or front wall of a squash court as well as the back wall. The panes, of course, have other uses than for squash courts.

This invention, in one broad form, provides a glass pane having a broken pattern of dots or lines of an opaque material applied to one side of the pane, the pattern being such that concentrated light from the side of the glass to which the pattern is applied is reflected to such an extent that persons on that side of the glass may see the wall and may "read" the path of an object moving relative to said wall whilst persons disposed on the other side of said wall may see through the wall to a sufficient extent to also follow the path of said moving object.

The invention will be further described with reference to glass panes for use in a squash court, and to squash courts including such panes. Squash courts have already been built in which the back wall is made of hardened plate glass with a spectator viewing area behind the glass wall. This enables more people to view a game than when an opaque back wall is used, the additional spectators viewing the game through the glass. Negligible inconvenience to the players is caused because the players have their backs to the back wall for most of the play. However, serious inconvenience would be caused if ordinary hardened plate glass were used for the whole or part of the side and front walls, due to reflections from the glass surface and due to movement of spectators behind the glass.

It has now been found that satisfactory results are obtained if glass panes made in accordance with this invention are used for the whole, or a part, of any of the walls of a squash court. Preferably, a pattern of fine white dots is applied to the inside surface of the glass, and this, together with differential lighting, gives an acceptable result. The players receive sufficient reflected light from the walls to "read" the wall, while enough light passes through the pattern to allow the audience to see the game; differential lighting ensures that the players cannot see the audience and thus be distracted by them and the audience are aware of the dot pattern only as a faint film, if at all.

In one embodiment of this invention the dots are applied to the glass surface by silk-screening a white ceramic ink onto plate glass. Subsequent heat toughening of the glass fuses the ceramic ink into the glass surface. An additional advantage of this process is that the pattern gives the glass a slightly raised texture which provides the squash ball with a "grip" similar to the surface of a conventional squash court wall. The pattern may preferably cover from 10% to 30% of the glass surface. A preferred dot distribution is 30 to 50 dots or lines to the linear inch for a squash court wall, although this can be varied according to the uses to which the glass panes are put.

The glass panes can be used as a strip set into a wall or the walls of a squash court, or other building, in a similar manner to that in which plate glass windows are mounted in a wall. Alternatively all of one wall, or all walls, may be constructed from the glass panes. The construction may be a demountable one giving a squash court that can be transported from one place to another.

A preferred embodiment of a demountable squash court incorporating glass pane walls according to this invention will now be described with reference to the accompanying drawings wherein.

Figure 1:
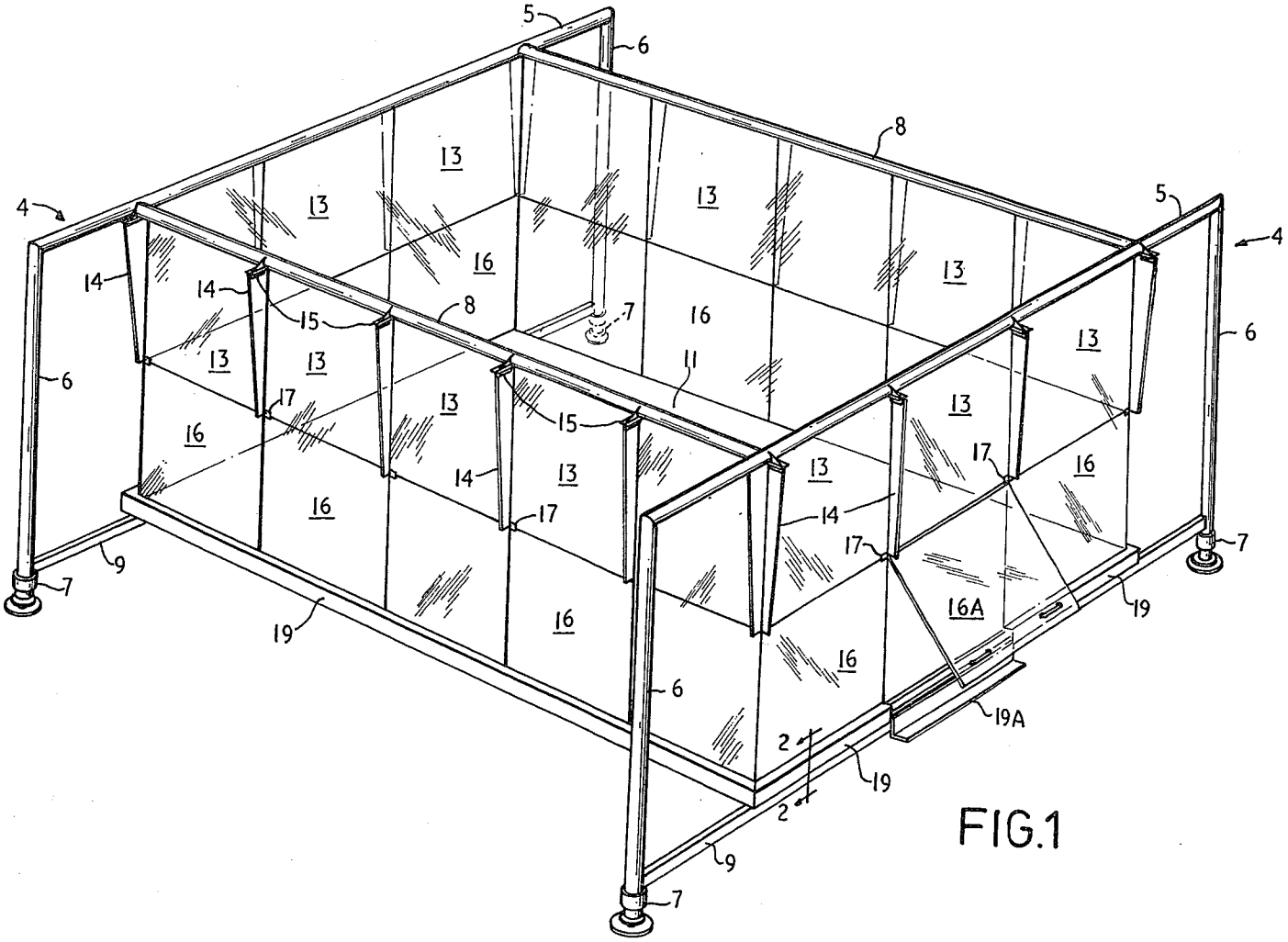
FIG. 1 is a perspective view of the squash court.

The squash court as illustrated in FIG. 1 comprises end frames 4 built up from horizontal tubular members 5 secured to the upper ends of vertical tubular standards 6. Each standard is provided with resilient pedestals 7, and the end frames are joined by longitudinal tubular members 8, the ends of which are secured to the members 5.

Figure 2:
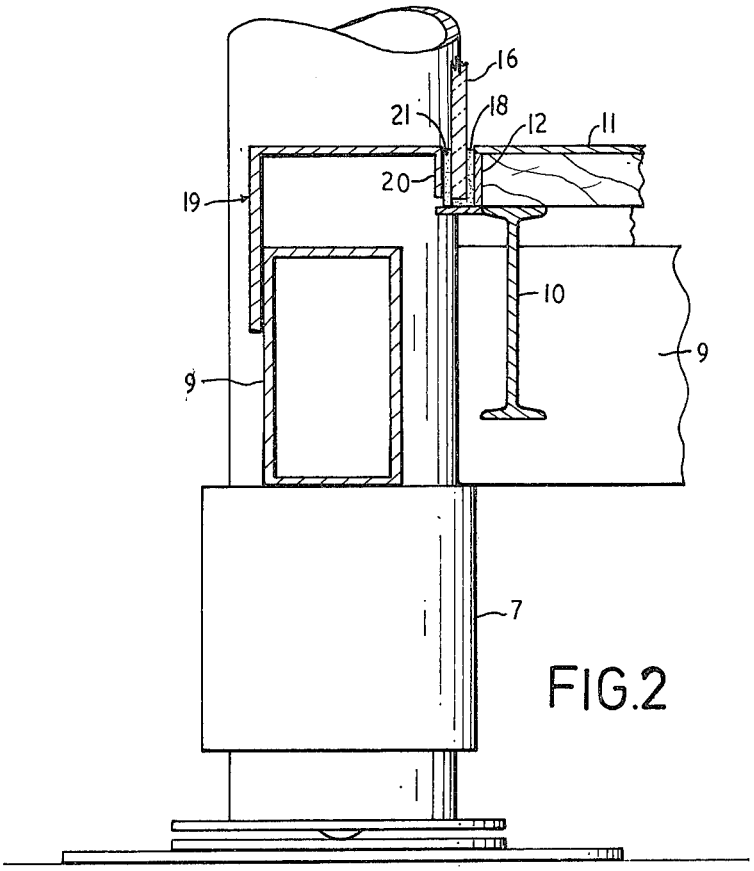
FIG. 2 is a fragmentary section on the line 2—2 in FIG. 1, to an enlarged scale.

Floor beams 9 of rectangular cross section extend between the vertical members 6 approximately one meter above the base of the pedestals 7. Floor joists 10 (see FIG. 2) extend between the beams 9, and support a playing floor surface 11. A trough 12 is formed about the periphery of the floor 11 for a purpose to be described later.

A series of glass panels 13 are suspended from the tubular members 5 and 8, and said panels are provided with a pattern of white lines (not shown).

Outrigger vertical glass gussets 14 are rigidly secured to metal brackets 15 extending tangentially from the underside of the tubular members 5 and 8. The gussets 14 are positioned adjacent the junction of each sheet 13 and support them in a vertical plane.

A second row of glass panels 16 are secured to the lower edges of the panels 13 by means of plates 17. The lower edges of the panels 16 are accommodated within the floor trough 12 (see FIG. 2) and a felt pad 18 is positioned between the glass and the trough 12.

An angular facia member 19 is secured to the outer surfaces of the members 9 with an inner face 20 of said facia 19 positioned adjacent the glass panels 16. A second felt pad 21 is positioned between the glass 16 and the facia 19.

One panel 16A is hingedly secured at its upper edge to the glass end wall so that it can be opened as an access door as shown in FIG. 1. A short length 19A of the facia 19 adjacent the panel 16A is hingedly secured thereto so it can be swung down to form a step to assist access.

Figure 3:
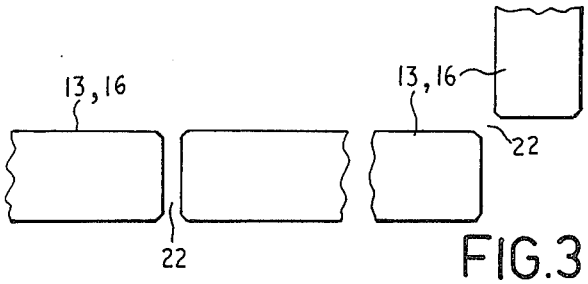
FIG. 3 is a fragmentary plan view of adjacent glass sheets showing the unfilled gap between said sheets.

To allow for expansion due to temperature changes an unfilled gap must be provided between the edges of the glass sheets 13 and 16. This gap of three millimeters is shown at 22 in FIG. 3.

What we claim is:

1. A squash, hand ball, racket ball or like court comprising a plurality of panes of glass each having a broken pattern of dots or lines of an opaque white material separate from the pane itself applied to one side of the pane, the other side of the pane being untreated and uncovered, the pattern being such that concentrated light from the side of the glass to which the pattern is applied is reflected to such an extent that persons on that side of the glass may see the wall and may "read" the path of an object moving relative to said wall whilst persons disposed on the other side of said wall may see through the wall to a sufficient extent to also follow the path of said moving object, and the court further comprising an overhead frame from which each of said panes is suspended, with an unfilled gap between adjacent panes of the order of 3 mm; and the court further comprising a floor member adapted for mounting approximately one meter above ground level, and wherein respective glass pane walls are suspended so that their lower edge portions are secured between a felt or like strip disposed around the floor edge and a second felt strip within a facia disposed in the plane of the floor.

2. A court as claimed in claim 1, wherein the pattern is applied to the panes of glass as a ceramic ink fused into the glass surface during a heat toughening step.

3. A court as claimed in claim 1, wherein said pattern occupies 10% to 30% of the surface of each pane.

4. A court as claimed in claim 1, wherein the pattern comprises 30 to 50 dots or lines to the linear inch.

* * * * *